US008358185B2

(12) United States Patent
Ohno et al.

(10) Patent No.: US 8,358,185 B2
(45) Date of Patent: Jan. 22, 2013

(54) WAVEGUIDE CONNECTION BETWEEN A DIELECTRIC SUBSTRATE AND A WAVEGUIDE SUBSTRATE HAVING A CHOKE STRUCTURE IN THE DIELECTRIC SUBSTRATE

(75) Inventors: Kazuto Ohno, Tokyo (JP); Takuya Suzuki, Tokyo (JP); Shigeo Udagawa, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 305 days.

(21) Appl. No.: 12/671,627

(22) PCT Filed: Jul. 31, 2008

(86) PCT No.: PCT/JP2008/063792

§ 371 (c)(1),
(2), (4) Date: Feb. 1, 2010

(87) PCT Pub. No.: WO2009/017203

PCT Pub. Date: Feb. 5, 2009

(65) Prior Publication Data

US 2011/0187482 A1 Aug. 4, 2011

(30) Foreign Application Priority Data

Aug. 2, 2007 (JP) ..... 2007-202272

(51) Int. Cl.
*H01P 1/04* (2006.01)
*H01P 5/02* (2006.01)

(52) U.S. Cl. ..... 333/254

(58) Field of Classification Search ..... 333/254, 333/255, 248, 246
See application file for complete search history.

(56) References Cited

U.S. PATENT DOCUMENTS

| | | | | |
|---|---|---|---|---|
| 2,883,632 | A * | 4/1959 | Street | 333/254 |
| 5,528,074 | A * | 6/1996 | Goto et al. | 257/664 |
| 7,592,887 | B2 * | 9/2009 | Chao et al. | 333/254 |
| 7,994,881 | B2 * | 8/2011 | Suzuki | 333/254 |
| 2003/0042993 | A1 | 3/2003 | Sayanagi et al. | |

FOREIGN PATENT DOCUMENTS

| | | |
|---|---|---|
| JP | 2001 267814 | 9/2001 |
| JP | 2003 78310 | 3/2003 |
| JP | 2005 278016 | 10/2005 |

(Continued)

OTHER PUBLICATIONS

U.S. Appl. No. 13/160,584, filed Jun. 15, 2011, Suzuki.

(Continued)

*Primary Examiner* — Benny Lee
(74) *Attorney, Agent, or Firm* — Oblon, Spivak, McClelland, Maier & Neustadt, L.L.P.

(57) ABSTRACT

A choke structure including: an inside surface conductive pattern formed in the surrounding of a through hole on the surface of a dielectric substrate opposing a waveguide substrate; an outside surface conductive pattern formed in the surrounding of the inside surface conductive pattern positioned apart therefrom; a conductor opening provided between the inside surface conductive pattern and the outside surface conductive pattern and in which a dielectric member is exposed; a dielectric transmission path short-circuited at an end that is formed by an inner layer conductor, which is provided away from the conductor opening by a predetermined distance in the layer-stacking direction of the dielectric substrate; and a plurality of penetrating conductors, which connect the inner layer conductor to the inside surface conductive pattern.

10 Claims, 8 Drawing Sheets

FOREIGN PATENT DOCUMENTS

| | | | |
|---|---|---|---|
| JP | 2006-278943 | A | 10/2006 |
| JP | 2007-336299 | A | 12/2007 |
| JP | 2008 113318 | | 5/2008 |
| JP | 4833026 | B2 | 12/2011 |

OTHER PUBLICATIONS

Office Action issued May 29, 2012, in Japanese patent Application No. 2009-525453 (with partial English-language translation).

* cited by examiner

WAVEGUIDE CONNECTION BETWEEN A DIELECTRIC SUBSTRATE AND A WAVEGUIDE SUBSTRATE HAVING A CHOKE STRUCTURE IN THE DIELECTRIC SUBSTRATE

TECHNICAL FIELD

The present invention relates to a connection structure of waveguides through which electromagnetic waves are transmitted, the waveguides being provided in a dielectric substrate and in a waveguide substrate that is made of metal or of which one or more surfaces are coated by metal.

BACKGROUND ART

In a conventional waveguide connection structure, the structure for connecting together a waveguide (i.e., a through hole) through which electromagnetic waves are transmitted and that is provided in an organic dielectric substrate (i.e., a connection member) and another waveguide that is provided in a metal waveguide substrate is configured such that a conductor in the through hole is electrically connected to the metal waveguide substrate so that electric potentials are maintained at the same level, for the purpose of preventing the electromagnetic waves from being reflected, having a passage loss, and leaking at the connection part (see, for example, Patent Document 1).

Patent Document 1: Japanese Patent Application Laid-open No. 2001-267814 (paragraph [0028] and FIG. 1)

SUMMARY OF THE INVENTION

In the conventional waveguide connection structure as described above, there may be a gap between the conductive layer in the through hole and the waveguide substrate due to warpage of the organic dielectric substrate and warpage of the metal waveguide substrate. As a result, a problem arises where the electromagnetic waves are reflected, have a passage loss, or leak, at the connection part.

In view of the circumstances described above, it is an object of the present invention to obtain a waveguide connection structure with which it is possible to reduce reflections, passage losses, and leakages of the electromagnetic waves, even when there is a gap between the through hole and the waveguide substrate due to, for example, warpage of the dielectric substrate and the waveguide substrate.

To achieve the object, a waveguide connection structure according to the present invention includes a dielectric substrate having a through hole of which an inner wall has a conductor provided thereon so that an electromagnetic wave is transmitted through the through hole; and a waveguide substrate that has a waveguide hole and is made of metal or of which a surface is coated by metal, wherein the waveguide connection structure has a choke structure including an inside surface conductive pattern that is formed in a surrounding of the through hole on a surface of the dielectric substrate opposing the waveguide substrate; an outside surface conductive pattern that is formed in a surrounding of the inside surface conductive pattern while being positioned apart from the inside surface conductive pattern; a conductor opening that is provided between the inside surface conductive pattern and the outside surface conductive pattern and in which a dielectric member is exposed; and a dielectric transmission path short-circuited at an end that is formed by an inner layer conductor and a plurality of penetrating conductors, the inner layer conductor being provided in a position that is away from the conductor opening by a predetermined distance in a layer-stacking direction of the dielectric substrate, and the plurality of penetrating conductors connecting the inner layer conductor to the inside surface conductive pattern and to the outside surface conductive pattern.

According to an aspect of the present invention, the dielectric substrate is provided with the choke structure that confines the electromagnetic waves therein. As a result, it is possible to reduce reflections, passage losses, and leakages of the transmitted electromagnetic waves at the waveguide connection part. In addition, because the choke structure is provided in the dielectric substrate that is configured with a material having a higher electric permittivity than that of air, it is possible to configure the depth of the choke structure so as to be shorter than other a choke structure that is formed by, for example, applying a cutting processing to generally-used waveguide substrates. As a result, it is possible to configure a device to which the waveguide connection structure is applied so as to be thin.

EXPLANATIONS OF LETTERS OR NUMERALS

Figure 1:
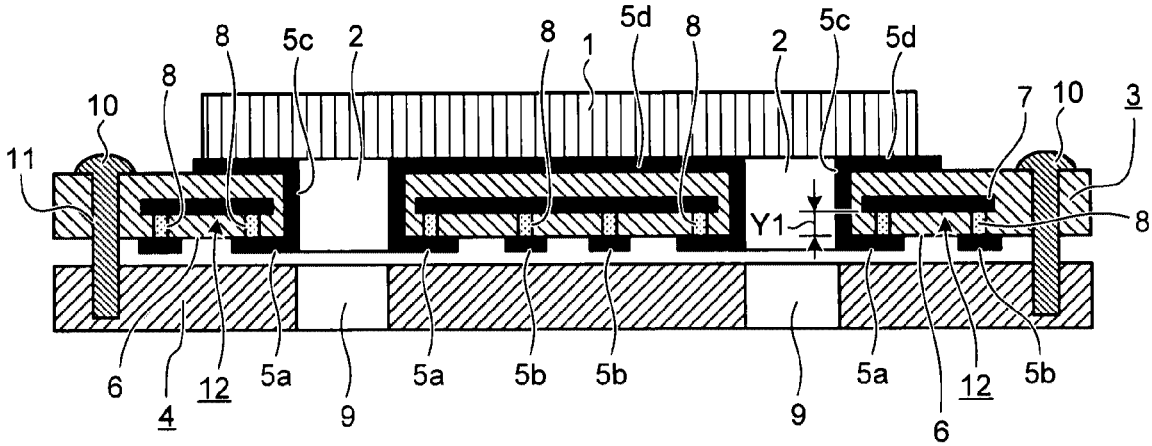
FIG. 1 is a cross-sectional view of a waveguide connection structure according to a first embodiment of the present invention.

1: High-frequency module
2: Through hole
3: Dielectric substrate
4: Waveguide substrate
5*a*: Inside surface conductive pattern, Surface conductor
5*c*: Inner wall conductor
5*b*: Outside surface conductive pattern
5*d*: Surface layer ground conductor
6: Conductor opening (opening)
7: Inner layer conductor (Inner layer ground conductor)
8: Penetrating conductor
9: Waveguide hole
10: Screw
11: Through hole
12: dielectric transmission path short-circuited at an end
13*a*: Inside inner layer conductive pattern
13*b*: Outside inner layer conductive pattern
14: Pattern wiring for signal wirings
15: Penetrating conductor for signal wirings
16: Dielectric layer
17: Dielectric part

BEST MODE(S) FOR CARRYING OUT THE INVENTION

In the following sections, exemplary embodiments of a waveguide connection structure according to the present invention will be described in detail, with reference to the accompanying drawings. The present invention is not limited to these exemplary embodiments.

First Embodiment

Figure 2:
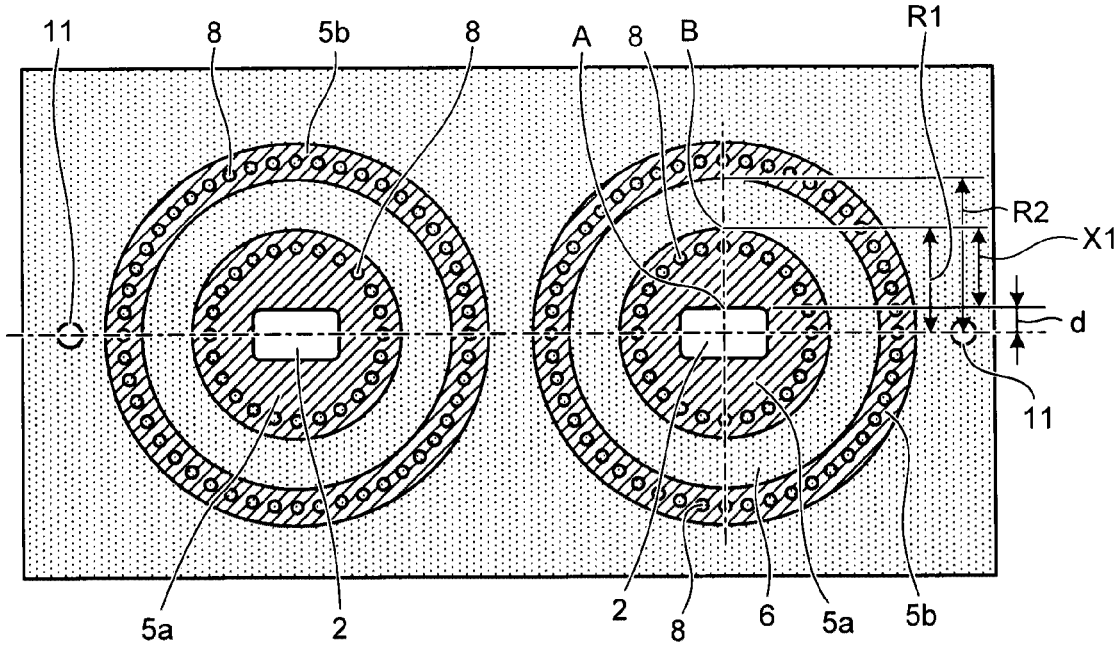
FIG. 2 is a drawing of patterns formed on a surface of a dielectric substrate opposing a waveguide substrate according to the first embodiment of the present invention.

FIG. 1 is a cross-sectional view of a waveguide connection structure according to a first embodiment of the present invention. FIG. 2 is a plan view of patterns formed on a surface of a dielectric substrate 3 opposing a waveguide substrate 4 according to the first embodiment of the present invention. The waveguide connection structure according to the first embodiment is applied to, for example, a millimeter wave radar or a microwave radar such as a Frequency-Modulated Continuous Wave (FM/CW) radar.

In the multi-layer dielectric substrate 3 (FIG. 1) on which a high-frequency module 1 (FIG. 1) including a high-frequency semiconductor is installed, a plurality of through holes 2 that are hollow and rectangular-shaped or cocoon-shaped and that function as waveguides are provided. The waveguide substrate 4 (FIG. 1) is made of metal or is configured with a resin of which one or more surfaces are coated by metal. In the waveguide substrate 4, a plurality of waveguide holes 9 (FIG. 1) that are hollow and rectangular-shaped or cocoon-shaped and that function as waveguides are provided. The dielectric substrate 3 and the waveguide substrate 4 are attached together by using screws 10 (FIG. 1) that are in through holes 11 provided in the dielectric substrate 3, in such a manner that the central axes of the through holes 2 coincide with the central axes of the waveguide holes 9, respectively. In FIG. 1, the gap between the dielectric substrate 3 and the waveguide substrate 4 is exaggerated so that the dielectric substrate 3 and the waveguide substrate 4 seemed to be positioned apart from each other.

The through holes 2 and the waveguide holes 9 are used for transmitting outgoing electromagnetic wave signals that are output from the high-frequency module 1 to an antenna unit (not shown) or incoming electromagnetic wave signals that are input from the antenna unit to the high-frequency module 1. These outgoing and incoming electromagnetic wave signals are collectively referred to as high-frequency signals.

An inner wall conductor 5*c* (FIG. 1) is provided on an inner circumferential wall of each of the through holes 2 provided in the dielectric substrate 3. Each of the inner wall conductors 5*c* is connected to a surface layer ground conductor 5*d* (FIG. 1) that is provided on the upper surface side of the dielectric substrate 3 and to an inside surface conductive pattern (i.e., a land part) 5*a* that is formed on the lower surface side (i.e., the side that abuts against the waveguide substrate 4) of the dielectric substrate 3. As shown in FIG. 2, each of the inside surface conductive patterns 5*a* is formed in a circular shape in the surrounding of the corresponding one of the through holes 2. A ring-shaped conductor opening (hereinafter, the "opening") 6 in which no surface conductor is provided so that the dielectric member is exposed is provided in the surrounding of each of the inside surface conductive patterns 5*a*. An outside surface conductive pattern 5*b* is formed in the surrounding of each of the ring-shaped openings 6. In other words, each of the outside surface conductive patterns 5*b* is formed in the surrounding of the corresponding one of the inside surface conductive patterns 5*a*, while being positioned apart from the inside surface conductive pattern 5*a* by a distance that is equal to the width of the corresponding one of the openings 6. In this situation, each of the outside surface conductive patterns 5*b* is formed so as to have a ring shape and is positioned apart, while the dielectric member is interposed therebetween, from any other outside surface conductive patterns 5*b* that are formed in the surroundings of the through holes 2 positioned adjacent thereto. As explained here, it is preferable to configure the outside surface conductive patterns 5*b* that are formed in the surroundings of the ring-shaped openings 6 in such a manner that the outside surface conductive patterns 5*b* are not connected to one another by conductive patterns, as shown in FIG. 2.

As shown in FIG. 2, each of the inside surface conductive patterns 5*a* is formed while using the central axis of the corresponding one of the through holes 2 as the center thereof, such that a distance X1 is approximately one fourth (¼) of a free-space wavelength λ of the high-frequency signal (i.e., the signal wave) transmitted through the through hole 2, where the distance X1 is the distance between a middle point A and an intersection point B, the middle point A being a middle point of a long-side edge (i.e., an E-plane edge) of the through hole 2, and an intersection point B being a point at which a line extended from the middle point A in the direction perpendicular to the long-side edge intersects the edge of the circular-shaped inside surface conductive pattern 5*a*. The radius R1 of each of the inside surface conductive patterns 5*a* is equal to the sum of the length X1 (=λ/4) and a length d that is a half of the short side of the through hole 2. In other words, each of the inside surface conductive patterns 5*a* has the shape of a circle that is centered on the central axis of the through hole 2 and that passes through the point positioned away from the middle point A of the E-plane edge of the through hole 2 by approximately λ/4.

A plurality of dielectric transmission paths 12 (FIG. 1), which is short-circuited at an end, is provided within the dielectric substrate 3, the dielectric transmission paths 12 short-circuited at an end each extending from the corresponding one of the openings 6 in the layer-stacking direction of the dielectric substrate 3 and each having a length of approximately λg/4. In this situation, "λg" denotes an effective wavelength of the high-frequency signal within the dielectric member (i.e., the effective wavelength within the substrate, hereinafter the "in-substrate effective wavelength"). More specifically, an inner layer ground conductor 7 is provided at a position that is away from the surface of the opening 6 by a distance Y1 (FIG. 1), which is approximately equal to one fourth (¼) of the in-substrate effective wavelength λg. The inner layer ground conductor 7 is connected to the inside surface conductive patterns 5*a* and to the outside surface conductive patterns 5*b* by a plurality of penetrating conductors (ground vias) 8 that each extend in the layer-stacking direction of the substrate. It is desirable to configure each of the intervals between the penetrating conductors 8 so as to be shorter than one fourth (¼) of the in-substrate effective wavelength λg, and preferably, so as to be equal to or shorter than one eighth (⅛) of the in-substrate effective wavelength λg. As explained here, each of the dielectric transmission paths 12 short-circuited at an end is ring shaped in a planar view, is provided so as to extend in the layer-stacking direction of the substrate from the position at which the opening 6 is provided. Each of the dielectric transmission paths 12 short-circuited at an end is a region of which the inner circumference and the outer circumference are surrounded by the penetrating conductors 8, whereas the tip end side thereof is enclosed by the inner layer ground conductor 7, while being filled with the dielectric member so that the transmitted electromagnetic waves do not leak therefrom.

According to the first embodiment, a choke structure is formed by each set made up of the inside surface conductive pattern 5*a*, the outside surface conductive pattern 5*b*, the opening 6, and the dielectric transmission path 12 short-circuited at an end.

When a choke structure as described above is adopted, a short circuit is achieved by the inner layer conductor 7 with the arrangements in which the distance Y1 is configured so as to be approximately equal to λg/4, whereas the distance X1 is configured so as to be approximately equal to λ/4. As a result, the edge (e.g., the point B) of the inside surface conductive pattern 5*a* is equivalent as being open for the transmitted electromagnetic waves. Further, the long-side edges (i.e., the E-plane) of the through hole 2 that are positioned away from this edge by the distance approximately equal to λ/4 is equivalent as being short-circuited. With this arrangement, it is possible to inhibit the signals from leaking at the connection parts between the through holes 2 provided in the dielectric substrate 3 and the waveguide holes 9 provided in the waveguide substrate 4. Consequently, it is possible to inhibit the signals from leaking into adjacent waveguide connection structure parts and to enhance the isolation properties. Furthermore, even if some signals have leaked, because each of the outside surface conductive patterns 5*b* is formed independently such that the patterns are separated from one another corresponding to the different waveguide connection structures, it is possible to cut off the transmission of the leaked signals in a parallel plate mode and to further enhance the level of isolation.

The dielectric member included in the dielectric substrate 3 has a relative permittivity that is larger than 1, so that the effective wavelength of the electromagnetic waves within the dielectric member is shorter than that in air. Thus, it is possible to configure the depth of the choke structure so as to be shorter than that of other choke structures in general that are formed by, for example, a cutting process and are filled with air. For example, one fourth (¼) of the free-space wavelength (in air) of the signal electromagnetic waves at 76 gigahertz (GHz) to 77 gigahertz used in an FM/CW radar installed in an automobile is approximately 0.98 millimeters. Thus, in the case where a choke structure is formed by a cutting process, the depth of the choke structure is approximately 0.98 millimeters. In contrast, because the relative permittivity of a generally-used glass epoxy substrate is approximately 4, one fourth (¼) of the in-substrate effective wavelength λg is approximately 0.49 millimeters.

For example, in the case where a glass epoxy substrate having a thickness of 1.0 millimeter is adopted as the dielectric substrate 3, if a choke structure was formed by performing a cutting processing and further providing a conductor therein by performing a plate processing or the like, the thickness of the substrate in a cut part would be approximately 0.02 millimeters, and it would be extremely difficult to achieve such a choke structure. In contrast, by configuring the choke structure with the patterns on the substrate such that the inside thereof is filled with the resin as described in the first embodiment, it is possible to configure the depth so as to be approximately 0.49 millimeters and achieve the desired choke structure easily. Further, even in a case where the thickness of the substrate is large enough to form a choke structure by performing a cutting processing, it is possible to keep the volume of the choke structure occupying the inside of the substrate small according to the first embodiment. Thus, by using the configuration according to the first embodiment, it is possible to configure the entirety of the device so as to be thin and compact.

Figure 3:
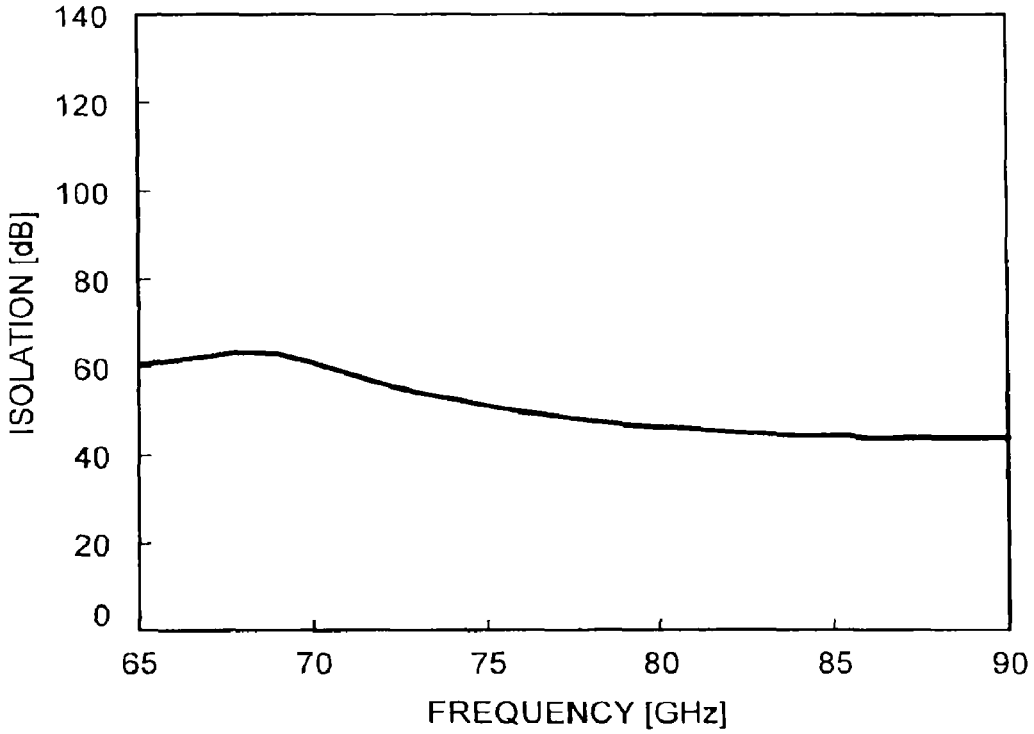
FIG.3 CONVENTIONAL ART
FIG. 3 is a chart of isolation properties between two waveguides that are obtained while a conventional waveguide connection structure is being used.
Figure 4:
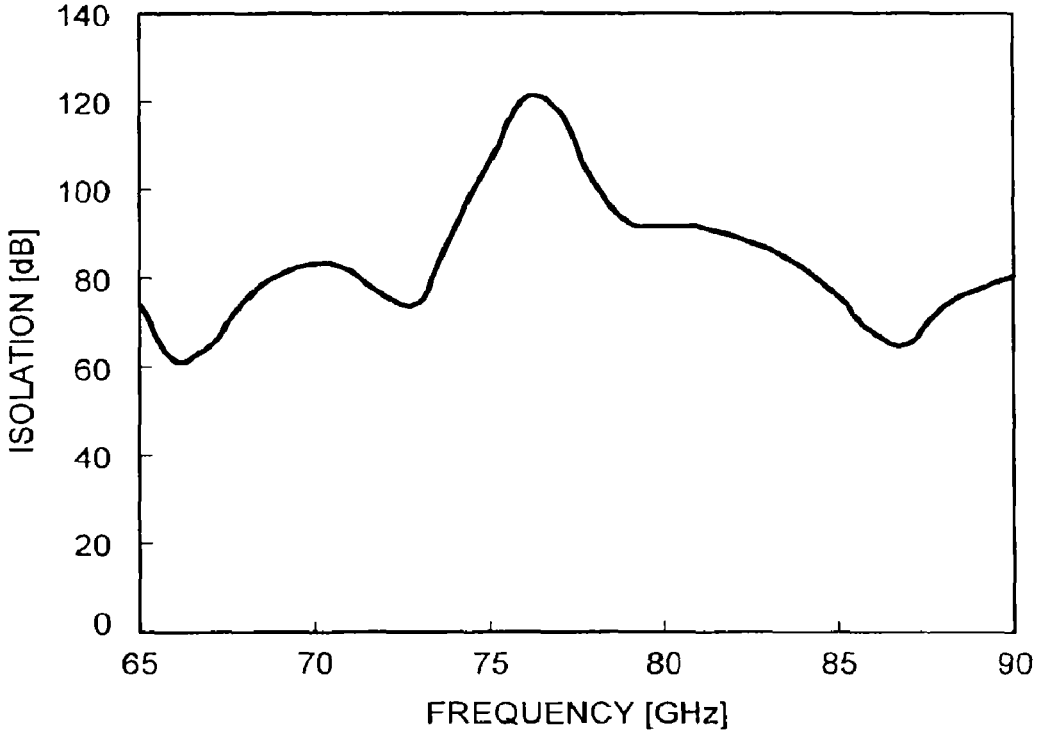
FIG. 4 is a chart of isolation properties between two waveguides that are obtained according to the first embodiment of the present invention.

FIG. 3 is a chart of a result of a simulation indicating isolation properties (i.e. isolation in dB vs. Frequency in GHz) between two waveguide connection structures positioned adjacent to each other, when adopting a conventional waveguide connection structure having no choke structure. FIG. 4 is a chart of a result of a simulation indicating isolation properties (i.e. isolation in dB vs. Frequency in GHz) between two waveguide connection structures positioned adjacent to each other, when adopting the choke structure according to the first embodiment. In the example of the conventional waveguide connection structure of which the isolation properties are shown in FIG. 3, the entirety of the surface of the dielectric substrate opposing the waveguide substrate is covered with a conductor. The dimension of each of the through holes is configured to be 2.50 millimeters by 0.96 millimeters so as to conform to the high-frequency module, whereas the dimension of each of the waveguide holes is configured to be 2.54 millimeters by 1.27 millimeters. The thickness of the dielectric substrate is 1.6 millimeters, whereas the dielectric member is made of a glass epoxy material, and the relative permittivity thereof is 4.0. The pitch between the two waveguide holes is 3.5 millimeters, whereas the gap between the dielectric substrate and the waveguide substrate is 0.2 millimeters. In contrast, in the example of the waveguide connection structure according to the first embodiment of which the isolation properties are shown in FIG. 4, the choke structure described above is provided in the conventional waveguide connection structure having the dimensions described above. As previously described in FIGS. 1, 2, the radius R1 of each of the inside surface conductive patterns 5*a* connected to the corresponding one of the through holes 2 is 1.6 millimeters, whereas the outer radius R2 of each of the openings 6 in which the dielectric member is exposed is 2.6 millimeters. The distance Y1 between the surface of the substrate and the inner layer conductor 7 is approximately 0.5 millimeters, whereas the width of each of the outside surface conductive patterns 5*b* is 0.6 millimeters. As apparent from a comparison between FIG. 3 and FIG. 4, the waveguide connection structure according to the first embodiment exhibits isolation properties that are improved by 65 decibel (dB) or more, at 76 gigahertz to 77 gigahertz, which is a band used by FM/CW radars installed in automobiles. Thus, it has been confirmed that it is possible to achieve a very advantageous effect.

In FIGS. 1 and 2, each of the inside surface conductive patterns 5*a* is circular shaped, whereas each of the openings 6 and each of the outside surface conductive patterns 5*b* is circular ring (annular) shaped. However, another arrangement is acceptable in which each of the inside surface conductive patterns 5*a* is polygonal shaped or the like, whereas each of the openings 6 and each of the outside surface conductive patterns 5*b* is polygonal ring (annular) shaped.

Second Embodiment

Figure 5:
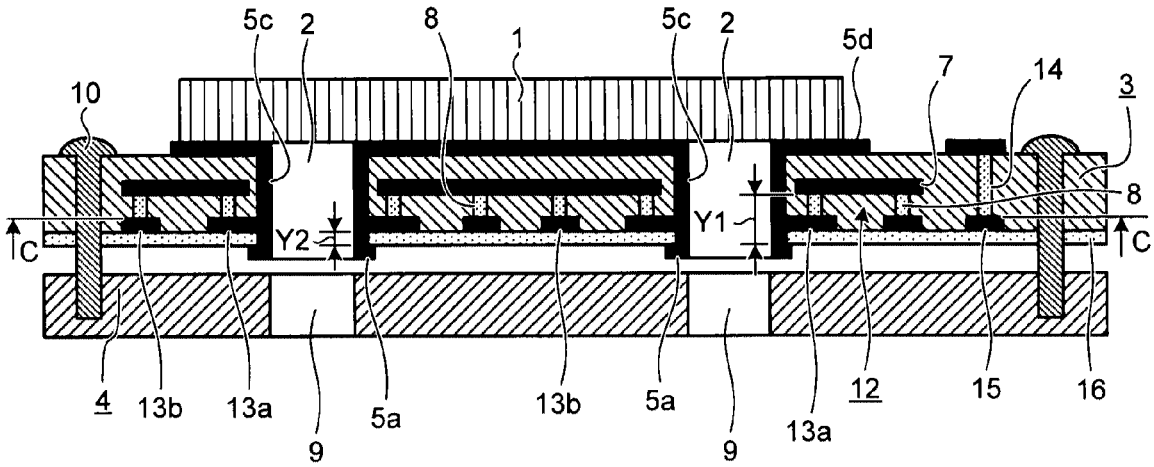
FIG. 5 is a cross-sectional view of a waveguide connection structure according to a second embodiment of the present invention.
Figure 6:
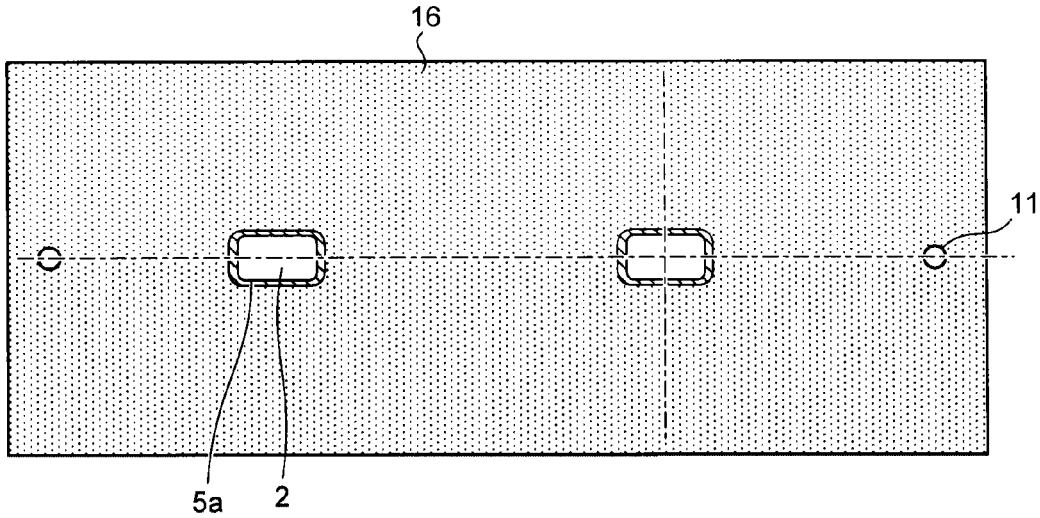
FIG. 6 is a drawing of patterns formed on the surface of the dielectric substrate opposing the waveguide substrate according to the second embodiment of the present invention.
Figure 7:
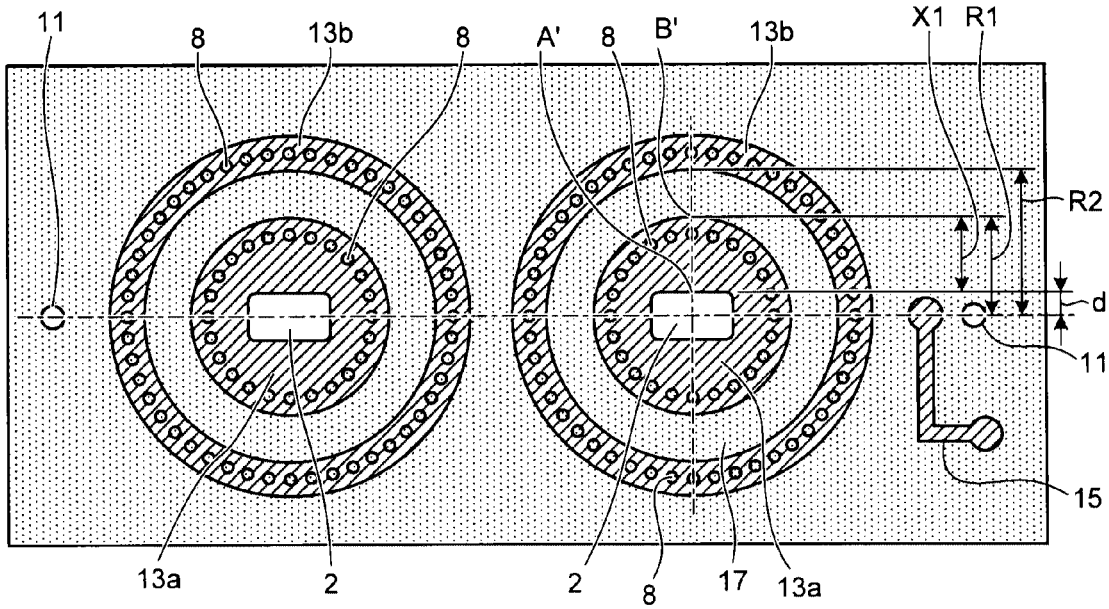
FIG. 7 is a drawing of patterns formed on an inner layer conductive layer in the dielectric substrate according to the second embodiment of the present invention.

Next, a second embodiment of the present invention will be explained, with reference to FIGS. 5 to 7. FIG. 5 is a cross-sectional view of a waveguide connection structure according to the second embodiment. FIG. 6 is a plan view of patterns formed on the surface of the dielectric substrate 3 opposing the waveguide substrate 4 according to the second embodiment. FIG. 7 is a drawing (i.e., a cross-sectional view at the line C-C in FIG. 5) of patterns of the conductor formed within the dielectric substrate 3 on such a layer that is positioned more inward, by one layer, than the lower surface layer of the dielectric substrate 3, according to the second embodiment. According to the second embodiment, a dielectric layer 16 (FIGS. 5, 6) that is formed by using a build-up method or the like is provided on the surface of the dielectric substrate 3 (FIG. 5) opposing the waveguide substrate 4 (FIG. 5). In the following sections, only the configurations that are different from those of the first embodiment will be explained. Explanation of the duplicate configurations will be omitted.

As shown in FIGS. 5 and 6, surface conductors 5*a* are provided on the surface of the dielectric substrate 3 opposing the waveguide substrate 4, the surface conductors 5*a* each having a required minimum dimension to provide the inner wall of the corresponding one of the through holes 2 with the conductor. There is no other surface conductor, and the dielectric layer 16 is thus exposed.

As shown in FIGS. 5 and 7, a choke structure that is the same as the one explained in the first embodiment is formed so as to extend from such an inner layer of the dielectric substrate 3 that is positioned more inward, by one layer, than the surface conductor 5*a*, toward the further inner layers. More specifically, an inside inner layer conductive pattern 13*a*, which is circular shaped, is formed in the surrounding of each of the through holes 2 on such an inner layer of the dielectric substrate 3 that is positioned more inward, by one layer, than the surface conductor 5*a*, while being connected to the inner wall conductor 5*c*. A dielectric part 17 (FIG. 7) that is ring shaped and is made of a dielectric member without any conductor is provided in the surrounding of each of the inside inner layer conductive patterns 13*a*. An outside inner layer conductive pattern 13*b*, which is ring shaped, is formed in the surrounding of each of the dielectric parts 17. The outside inner layer conductive patterns 13*b* that are formed in the surroundings of the through holes 2, which are positioned adjacent to one another, are positioned apart from one another, while the dielectric member is interposed therebetween.

Like in the first embodiment, FIG. 7 depicts each of the inside inner layer conductive patterns 13*a* is formed while using the central axis of the corresponding one of the through holes 2 as the center thereof, such that the distance X1 is approximately one fourth (¼) of the free-space wavelength λ of the signal wave transmitted through the through hole 2, where the distance X1 is the distance between a middle point A' and an intersection point B'. The middle point A' is a middle point of a long-side edge (i.e., an E-plane edge) of the through hole 2, and the intersection point B' is a point at which a line extending from the middle point A' in the direction perpendicular to the long-side edge intersects the edge of the circular-shaped inside inner layer conductive pattern 13*a*. The radius R1 of each of the inside inner layer conductive patterns 13*a* is equal to the sum of the length X1 (=λ/4) and the length d that is a half of the short side of the through hole 2. R2 is the outer diameter of the dielectric part 17 (FIG. 7).

Each of the dielectric transmission paths 12 short-circuited at an end is provided within the dielectric substrate 3, so as to extend from the dielectric part 17 in the layer-stacking direction of the dielectric substrate 3. More specifically, the inner layer ground conductor 7 is provided at a position that is away from the surface of the dielectric substrate 3 opposing the waveguide substrate 4 by the distance Y1 (=λg/4) as shown in FIG. 5. The inner layer ground conductor 7 is connected to the inside inner layer conductive patterns 13*a* and to the outside inner layer conductive patterns 13*b* by the plurality of penetrating conductors 8 (FIGS. 5, 7) that each extend in the layer-stacking direction of the substrate. It is desirable to configure a thickness Y2 (FIG. 5) of the dielectric layer 16 that is formed by using a build-up method or the like on the surface of the dielectric substrate 3 opposing the waveguide substrate 4 so as to be very small, and preferably, so much smaller than the distance Y1 that the thickness Y2 is negligible. As explained here, each of the dielectric transmission paths 12 short-circuited at an end having a ring shape in a planar view is provided within the dielectric substrate 3, the dielectric transmission paths 12 short-circuited at an end each being a region of which the inner circumference and the outer circumference are surrounded by the penetrating conductors 8, whereas the tip end side thereof is enclosed by the inner layer ground conductor 7, while being filled with the dielectric member so that the transmitted electromagnetic waves do not leak therefrom.

According to the second embodiment, because the dielectric transmission paths 12 short-circuited at an end and the inside inner layer conductive patterns 13*a* are provided, short circuits are equivalently achieved in connection parts between the inside inner layer conductive patterns 13*a* and the inner wall conductors 5*c* (FIG. 5) provided on the inner walls of the through holes 2. In addition, in the case where the width of each of the surface conductors 5*a* is configured so as to be small, and further, the thickness Y2 of the dielectric layer 16 is configured so as to be very small by using a build-up method or the like as explained above, for example, comparing with the distance Y1 that the thickness Y2 is negligible, short circuits are equivalently achieved also in the connection parts between the through holes 2 and the waveguide holes 9. With these arrangements, it is possible to inhibit the signals from leaking at the connection parts between the through holes 2 provided in the dielectric substrate 3 and the waveguide holes 9 provided in the waveguide substrate 4. As a result, it is possible to inhibit the signals from leaking into adjacent waveguide connection structure parts and to enhance the isolation properties.

Furthermore, the surface conductors 5*b*, which are provided according to the first embodiment, are not provided according to the second embodiment. Thus, when the dielectric substrate 3 and the waveguide substrate 4 are joined together, an advantageous effect is achieved where it becomes easier for the surface conductor 5*a* to come in contact, thus it is less likely that the through holes 2 and the waveguide holes 9 have gaps therebetween.

Choke structures that have an advantageous effect of confining electromagnetic waves therein like the dielectric transmission paths 12 short-circuited at an end are originally designed so as to function when a gap has occurred in the connection parts. Thus, by providing the dielectric layer 16 like in the second embodiment, it is possible to allow the choke structure provided in the dielectric substrate 3 and the waveguide substrate 4 to have a certain gap therebetween. Thus, another advantageous effect is achieved where it is easier to achieve the electromagnetic wave confining effect of the dielectric transmission paths 12 short-circuited at an end, stably.

In addition, according to the second embodiment, because the dielectric layer 16 is provided, a pattern wiring for signal wirings 14 (FIG. 5) and a penetrating conductor for signal wirings 15 (FIGS. 5,7) that are provided within the dielectric substrate 3 are not connected up to the surface of the dielectric substrate 3 that is in contact with the waveguide substrate 4. As a result, yet another advantageous effect is achieved where it is not necessary to provide the surface of the dielectric substrate 3 that is in contact with the waveguide substrate 4 with any special electrically-insulating structure.

It is desirable if each of the surface conductors 5*a* according to the second embodiment is configured so as to have a required minimum width to provide the inner wall of the through hole with the inner wall conductor 5*c*; however, even if each of the surface conductors 5*a* is configured so as to extend from the inner wall conductor 5*c* to a position that is more inward than the end edge of the inside inner layer conductive pattern 13*a*, it is possible to make the isolation properties better than in the conventional example.

Third Embodiment

Figure 8:
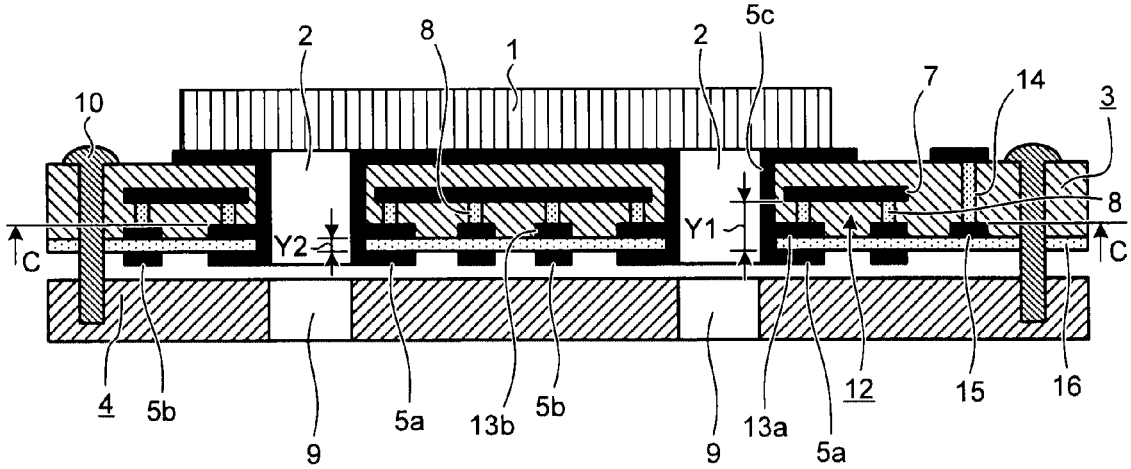
FIG. 8 is a cross-sectional view of a waveguide connection structure according to a third embodiment of the present invention.
Figure 9:
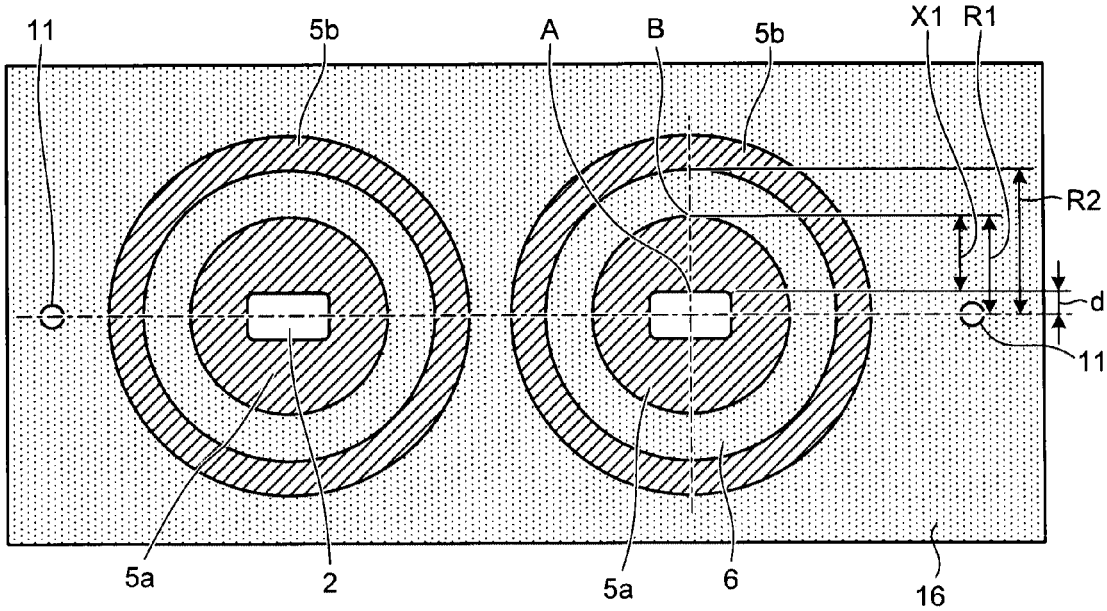
FIG. 9 is a drawing of patterns formed on the surface of the dielectric substrate opposing the waveguide substrate according to the third embodiment of the present invention.
Figure 10:
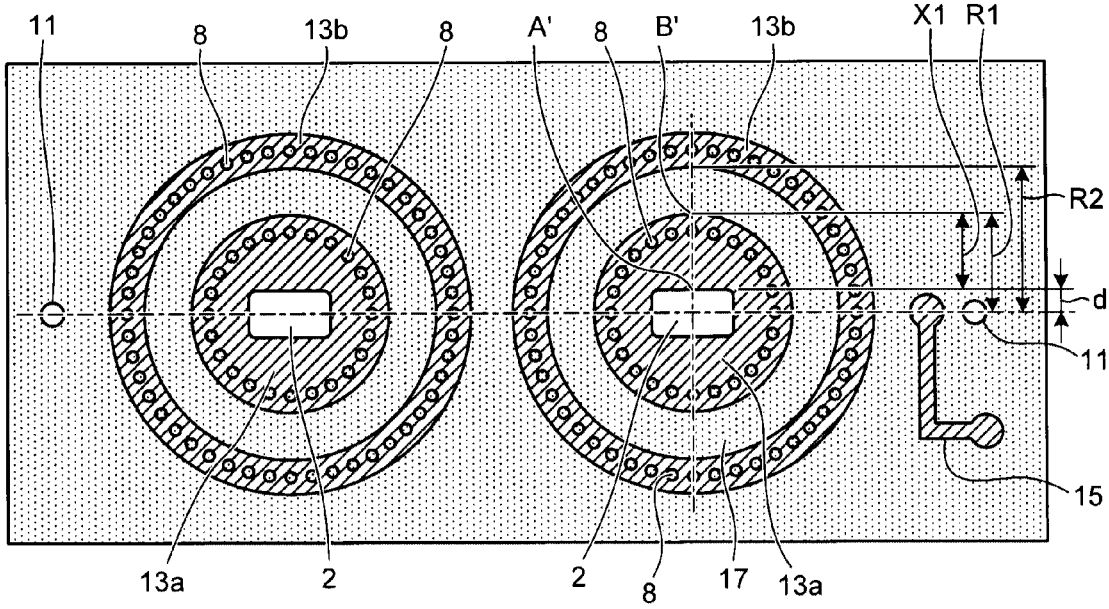
FIG. 10 is a drawing of patterns formed on an inner layer conductive layer in the dielectric substrate according to the third embodiment of the present invention.

Next, a third embodiment of the present invention will be explained with reference to FIGS. 8 to 11. FIG. 8 is a cross-sectional view of a waveguide connection structure according to the third embodiment. FIG. 9 is a plan view of patterns formed on the surface of the dielectric substrate 3 opposing the waveguide substrate 4 according to the third embodiment. FIG. 10 is a drawing (i.e., a cross-sectional view at the line C-C in FIG. 8) of patterns of the conductor formed within the dielectric substrate 3 on such a layer that is positioned more inward, by one layer, than the lower surface layer of the dielectric substrate 3, according to the third embodiment.

According to the third embodiment, like in the second embodiment, the dielectric layer 16 (FIGS. 8, 9) that is formed by using a build-up method or the like is provided on the surface of the dielectric substrate 3 (FIG. 8) opposing the waveguide substrate 4 (FIG. 8). In addition, the inside surface conductive patterns 5*a* (FIGS. 8,9) and the outside surface conductive patterns 5*b* (FIGS. 8,9), which are the same as those in the first embodiment, are further formed on the surface of the dielectric layer 16. It should be noted, however, that the inside surface conductive patterns 5*a* are not connected to the inside inner layer conductive patterns 13*a* (FIGS. 8, 10) by the penetrating conductors 8 (FIGS. 8, 10) and that the outside surface conductive patterns 5*b* are not connected to the outside inner layer conductive patterns 13*b* (FIGS. 8, 10) by the penetrating conductors 8, either.

As shown in FIGS. 8 and 9, each of the inside surface conductive patterns 5*a*, which is circular shaped, is formed in the surrounding of the corresponding one of the through holes 2 on the surface of the dielectric layer 16, while being connected to the inner wall conductor 5*c* (FIG. 8). Each of the ring-shaped conductor openings 6 (FIG. 9), in which no conductor is provided so that the dielectric member is exposed, is provided in the surrounding of the corresponding one of the inside surface conductive patterns 5*a*. Further, each of the ring-shaped outside surface conductive patterns 5*b* is formed in the surrounding of the corresponding one of the conductor openings 6. The outside surface conductive patterns 5*b* that are formed in the surroundings of the through holes 2, which are positioned adjacent to one another, are positioned apart from one another, while the dielectric member is interposed therebetween. Like in the first embodiment, FIG. 9 depicts each of the inside surface conductive patterns 5*a* is formed while using the central axis of the corresponding one of the through holes 2 as the center thereof, such that the distance X1 is approximately equal to $\lambda/4$, where the distance X1 is the distance between the middle point A and the intersection point B. The middle point A is a middle point of the long-side edge (i.e., the E-plane edge) of the through hole 2, and the intersection point B is a point at which a line extending from the middle point A in the direction perpendicular to the long-side edge intersects the edge of the circular-shaped inside surface conductive pattern 5*a*. The radius R1 of each of the inside surface conductive patterns 5*a* is equal to the sum of the length X1 ($=\lambda/4$) and the length d that is a half of the short side of the through hole 2.

As shown in FIGS. 8 and 10, a choke structure that is the same as the one explained in the second embodiment is formed on an inner layer of the dielectric substrate 3. More specifically, on such an inner layer of the dielectric substrate 3 that is positioned more inward, by one layer, than the inside surface conductive pattern 5*a*, each of the circular-shaped inside inner layer conductive patterns 13*a* is formed in the surrounding of the corresponding one of the through holes 2, while being connected to the inner wall conductor 5*c*. Each of the ring-shaped dielectric parts 17 (FIG. 10) that is made of the dielectric member with no conductor, is provided in the surrounding of the corresponding one of the inside inner layer conductive patterns 13*a*. Each of the ring-shaped outside inner layer conductive patterns 13*b* is formed in the surrounding of the corresponding one of the dielectric parts 17. The outside inner layer conductive patterns 13*b* that are formed in the surroundings of the through holes 2, which are positioned adjacent to one another, are positioned apart from one another, while the dielectric member is interposed therebetween. Like in the second embodiment, FIG. 10 depicts each of the inside inner layer conductive patterns 13*a* is formed while using the central axis of the corresponding one of the through holes 2 as the center thereof, such that the distance $\lambda$1 is approximately equal to $\lambda$4, where the distance X1 is the distance between the middle point A' and the intersection point B'. The middle point A' is a middle point of the long-side edge (i.e., the E-plane edge) of the through hole 2, and the intersection point B' is a point at which a line extended from the middle point A' in the direction perpendicular to the long-side edge intersects the edge of the circular-shaped inside inner layer conductive pattern 13*a*. The radius R1 of each of the inside inner layer conductive patterns 13*a* is equal to the sum of the length X1 ($=\lambda/4$) and the length d that is a half of the short side of the through hole 2. R2 (FIGS. 9, 10) is the outer diameter of the dielectric part 17 (FIG. 10).

Each of the dielectric transmission paths 12 (FIG. 8) short-circuited at an end is provided within the dielectric substrate 3, so as to extend from the dielectric part 17 in the layer-stacking direction of the dielectric substrate 3. More specifically, the inner layer ground conductor 7 is provided at the position that is away from the surface of the dielectric substrate 3 opposing the waveguide substrate 4 by the distance Y1 (=λg/4) as shown in FIG. 8. The inner layer ground conductor 7 is connected to the inside inner layer conductive patterns 13*a* and to the outside inner layer conductive patterns 13*b* by the plurality of penetrating conductors 8 that each extend in the layer-stacking direction of the substrate. It is desirable to configure the thickness Y2 (FIG. 8) of the dielectric layer 16 that is formed by using a build-up method or the like on the surface of the dielectric substrate 3 opposing the waveguide substrate 4 so as to be very small, and preferably, so much smaller than the distance Y1 that the thickness Y2 is negligible. As explained here, each of the dielectric transmission paths 12 short-circuited at an end is ring shaped in a planar view and is provided within the dielectric substrate 3. Each of the dielectric transmission paths 12 short-circuited at an end is a region of which the inner circumference and the outer circumference are surrounded by the penetrating conductors 8, whereas the tip end side thereof is enclosed by the inner layer ground conductor 7 (FIG. 8), while being filled with the dielectric member so that the transmitted electromagnetic waves do not leak therefrom.

Figure 11:
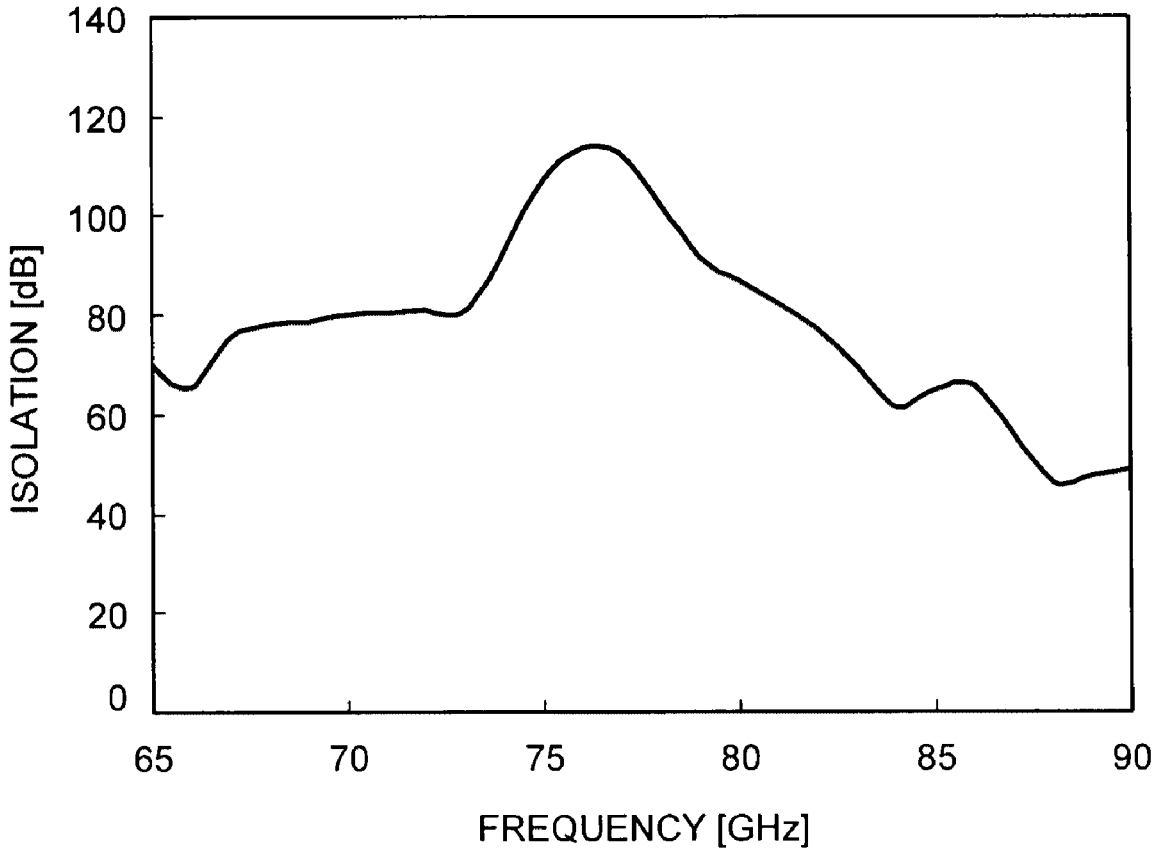
FIG. 11 is a chart of isolation properties between two waveguides that are obtained while the connection structure according to the third embodiment of the present invention is being used.

FIG. 11 is a chart of a result of a simulation indicating isolation properties (i.e. isolation in dB vs. Frequency in GHz) between two waveguide connection structures that are positioned adjacent to each other, when adopting the choke structure according to the third embodiment. In this situation, the thickness Y2 of the dielectric layer 16 is configured to be 0.070 millimeters. The other dimensions are the same as those in the first embodiment as shown in FIG. 4. As understood from FIGS. 4 and 11, isolations properties that are substantially the same as those according to the first embodiment are achieved in the third embodiment as well. Thus, by forming the dielectric layer 16 on the surface of the dielectric substrate 3 opposing the waveguide substrate 4 by using a build-up method or the like, it is possible to achieve the isolation properties that are substantially the same as those in the first embodiment, even in the case where the penetrating conductive patterns 8 are not connecting the inside surface conductive patterns 5*a* to the inside inner layer conductive patterns 13*a* and where the penetrating conductors 8, are not connecting the outside surface conductive patterns 5*b* to the outside inner layer conductive patterns 13*b*. By using a structure like this, it is not necessary to provide the penetrating conductors 8, which are formed by applying a laser processing or a plate processing to the dielectric substrate 3, so as to connect the inside surface conductive patterns 5*a* to the inside inner layer conductive patterns 13*a* and to further connect the outside surface conductive patterns 5*b* to the outside inner layer conductive pattern 13*b*. Thus, another advantageous effect is achieved where it is possible to easily structure the dielectric substrate 3 at a lower cost.

Fourth Embodiment

Figure 12:
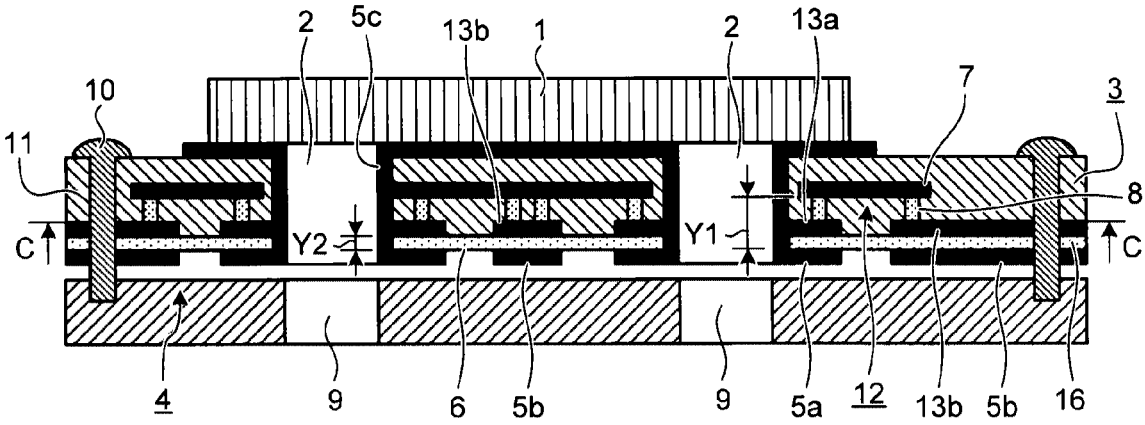
FIG. 12 is a cross-sectional view of a waveguide connection structure according to a fourth embodiment of the present invention.
Figure 13:
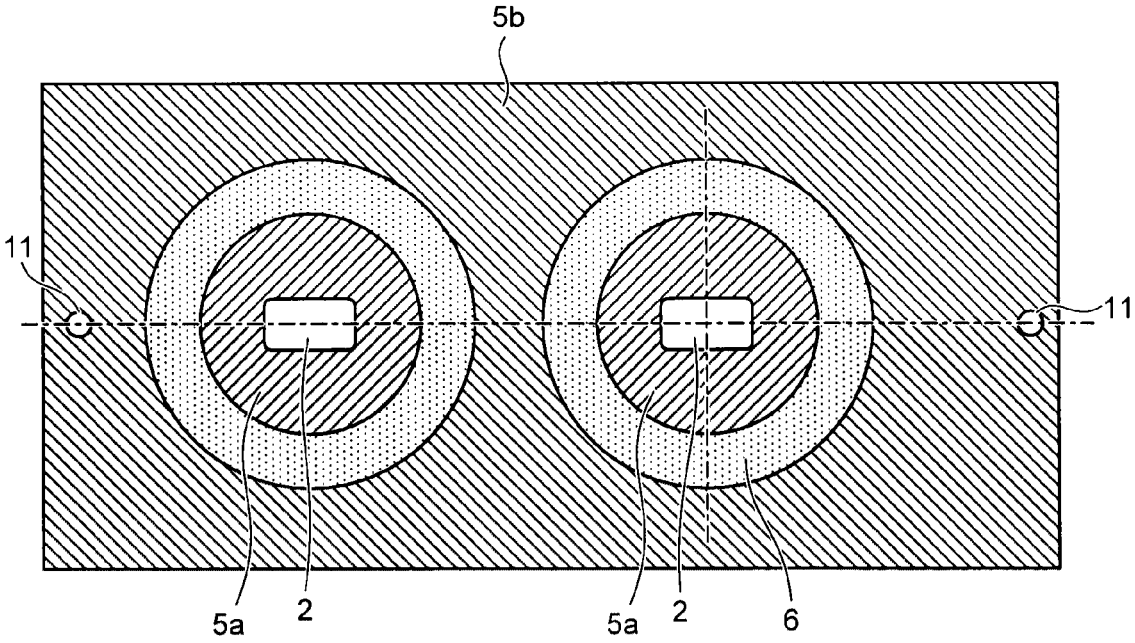
FIG. 13 is a drawing of patterns formed on the surface of the dielectric substrate opposing the waveguide substrate according to the fourth embodiment of the present invention.
Figure 14:
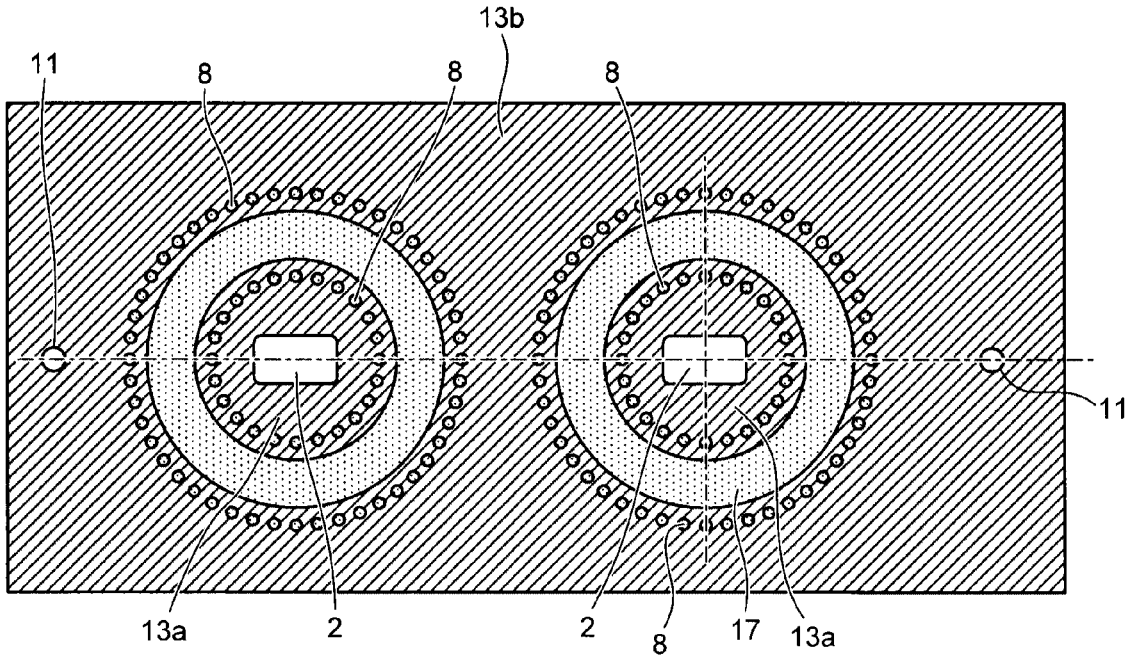
FIG. 14 is a drawing of patterns formed on an inner layer conductive layer in the dielectric substrate according to the fourth embodiment of the present invention.

Next, a fourth embodiment of the present invention will be explained with reference to FIGS. 12 to 15. FIG. 12 is a cross-sectional view of a waveguide connection structure according to the fourth embodiment. FIG. 13 is a plan view of patterns formed on the surface of the dielectric substrate 3 opposing the waveguide substrate 4 according to the fourth embodiment. FIG. 14 is a drawing (i.e., a cross-sectional view at the line C-C in FIG. 12) of patterns of the conductor formed within the dielectric substrate 3 on such a layer that is positioned more inward, by one layer, than the lower surface layer of the dielectric substrate 3, according to the fourth embodiment.

According to the third embodiment, the outside surface conductive patterns 5*b* (FIGS. 12, 13), each of which is formed in the surrounding of the corresponding one of the inside surface conductive patterns 5*a* (FIGS. 12, 13) while the conductor opening 6 (FIGS. 12, 13) in which the dielectric member is exposed is interposed therebetween, are separated from one another in correspondence with each of the waveguide connection structures. Also, the outside inner layer conductive patterns 13*b* (FIGS. 12, 14), each of which is formed in the surrounding of the corresponding one of the inside inner layer conductive patterns 13*a* (FIG. 12) while the dielectric part 17 (FIG. 14) that is made of the dielectric member without having any conductor is interposed therebetween, are separated from one another in correspondence with each of the waveguide connection structures. In contrast, according to the fourth embodiment, as shown in FIG. 12, the outside surface conductive pattern 5*b* is formed as being joined together for all the waveguide connection structures, and also, the outside inner layer conductive pattern 13*b* is formed as being joined together for all the waveguide connection structures. In the example shown in FIGS. 13 and 14, the outside surface conductive pattern 5*b* and the outside inner layer conductive pattern 13*b* are each indicated as a ground pattern that spreads as a solid pattern. The other configurations are the same as those in the third embodiment. The duplicate explanation will be omitted.

Figure 15:
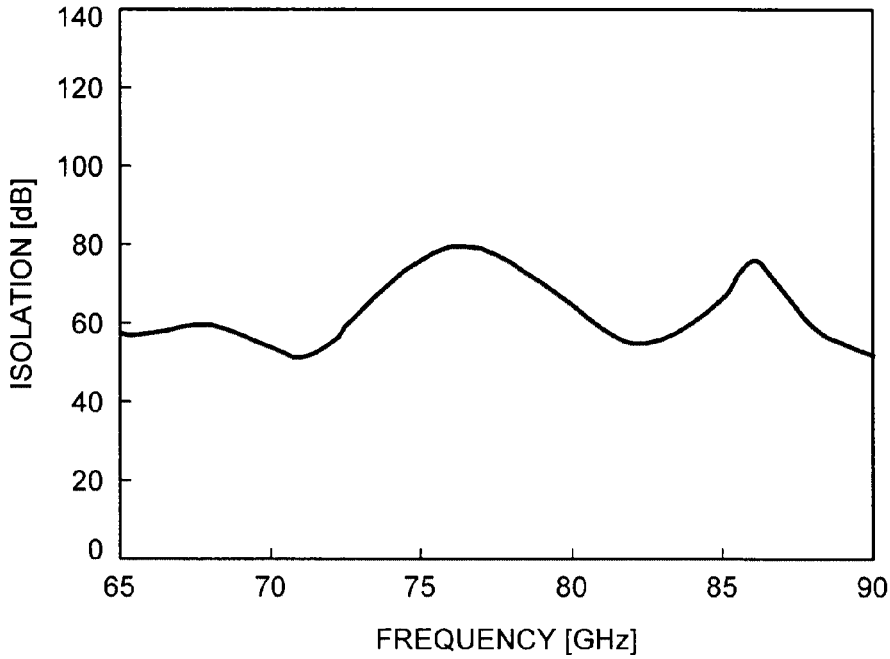
FIG. 15 is a chart of isolation properties between two waveguides that are obtained while the connection structure according to the fourth embodiment of the present invention is being used.

FIG. 15 is a chart of a result of a simulation indicating isolation properties (i.e. isolation in dB vs. Frequency in GHz) between two waveguide connection structures that are positioned adjacent to each other, when adopting the choke structure according to the fourth embodiment. In this situation, the thickness Y2 of the dielectric layer 16 is configured to be 0.070 millimeters as shown in FIG. 12. The other dimensions are the same as those in the first embodiment shown in FIG. 4. As shown in FIG. 13, the surface of the dielectric substrate 3 (FIG. 12) in the surroundings of the inside surface conductive patterns 5*a* is covered by the outside surface conductive pattern 5*b*, which spreads as the solid pattern. Also, as shown in FIG. 14, the circumferences of the inside inner layer conductive patterns 13*a* are surrounded by the outside inner layer conductive pattern 13*b*, which spreads as the solid pattern. As understood from a comparison of FIGS. 4, 11, and 15, the isolation properties according to the fourth embodiment are slightly worse than those in the examples in the first and the third embodiments; however, the isolation properties are better than those according to the conventional technique shown in FIG. 3.

As described above, according to the second, the third, and the fourth embodiments, the dielectric layer 16 is provided on the surface of the dielectric substrate 3 opposing the waveguide substrate 4 (FIG. 12), and the surface conductor having the various types of patterns is provided on the surface side of the dielectric layer 16. As shown in FIG. 12, by configuring the surface conductor so as to spread outward from the inner wall conductors 5*c* on the surface of the dielectric layer 16, in such a manner that the surface conductor does not cover the dielectric parts 17 (see FIGS. 7 and 10) provided between the inside inner layer conductive patterns 13*a* and the outside inner layer conductive patterns 13*b*, it is possible to make the isolation properties better than those according to the conventional technique.

In the third and the fourth embodiments described above, the surface conductors 5*a* and 5*b* as well as the inner layer conductors 13*a* and 13*b* are not connected to one another by the penetrating conductors 8; however, another arrangement is acceptable in which they are connected to one another by the penetrating conductors 8. Further, when a third inner layer conductor is provided between the inner layer conductors 13*a* and 13*b* and the inner layer conductor 7 (FIG. 12), and when the distance between the inner layer conductor 7 and the third inner layer conductor or the distance between the inner layer conductors 13*a* and 13*b* and the third inner layer conductor is configured to be shorter than λg/4, and preferably, to be equal to or shorter than λg/8, the effect of shielding the transmitted electromagnetic waves will be large enough. Thus, yet another arrangement is acceptable in which the penetrating conductors 8 that connect the inner layer conductors 13*a* and 13*b* to the inner layer conductor 7 are omitted.

In the first through the fourth embodiments described above, the choke structure is applied to both of the two waveguide connection structures. However, there is no restriction as to how many choke structures should be provided. Thus, as long as the isolation properties are at a satisfying level, it is acceptable to apply the choke structure according to any of the first through the fourth embodiments to only a part of the waveguide connection structures, instead of applying the choke structure to all the waveguide connection structures.

INDUSTRIAL APPLICABILITY

As explained above, the waveguide connection structure according to an aspect of the present invention is useful as a connection structure between a dielectric substrate and a waveguide substrate, the dielectric substrate having through holes of which the inner walls have conductors provided thereon so that electromagnetic waves can be transmitted through the through holes, and the waveguide substrate having waveguide holes and being made of metal or having one or more surfaces thereof coated by metal.

The invention claimed is:

1. A waveguide connection structure that comprises:

a dielectric substrate having a through hole of which an inner wall has a conductor provided thereon so that an electromagnetic wave is transmitted through the through hole; and a waveguide substrate that has a waveguide hole and is made of metal or of which a surface is coated by metal, wherein the waveguide connection structure has a choke structure including, an inside inner layer conductive pattern that is formed in a surrounding of the through hole on an inner layer of the dielectric substrate, an outside inner layer conductive pattern that is formed in a surrounding of the inside inner layer conductive pattern on the inner layer of the dielectric substrate while being positioned apart from the inside inner layer conductive pattern, a dielectric part that is positioned between the inside inner layer conductive pattern and the outside inner layer conductive pattern, a dielectric transmission path short-circuited at an end that is formed by an inner layer conductor and a plurality of penetrating conductors, the inner layer conductor being provided in a position that is apart from the dielectric part by a predetermined distance in a layer-stacking direction of the dielectric substrate, and the plurality of penetrating conductors connecting the inner layer conductor to the inside inner layer conductive pattern and to the outside inner layer conductive pattern, a surface dielectric layer that is provided on the inside inner layer conductive pattern and the outside inner layer conductive pattern so as to oppose the waveguide substrate, and a surface conductor that is provided in a surrounding of the through hole on the surface dielectric layer, which is a surface of the dielectric substrate opposing the waveguide substrate, while extending outward from the conductor provided on the inner wall of the through hole such that the dielectric part is not covered thereby.

2. The waveguide connection structure according to claim 1, wherein the surface conductor extends from the conductor provided on the inner wall of the through hole up to a position that is more inward than an edge position of the inside inner layer conductive pattern, and the surface conductor has a required minimum width to provide the inner wall of the through hole with the conductor.

3. The waveguide connection structure according to claim 2, wherein the through hole and the waveguide hole are both rectangular-shaped, the inside inner layer conductive pattern is circular shaped that is centered on a central axis of the through hole and that passes through a point positioned away from a middle point of an E-plane edge of the through hole by approximately λ/4, where λ denotes a free-space wavelength of a signal wave, and the dielectric part is ring shaped that is formed in a surrounding of the inside inner layer conductive pattern which is circular shaped.

4. The waveguide connection structure according to claim 3, wherein a distance from the surface of the dielectric substrate opposing the waveguide substrate to the inner layer conductor is approximately equal to one fourth of an in-substrate effective wavelength of the signal wave.

5. The waveguide connection structure according to claim 2, wherein a distance from the surface of the dielectric substrate opposing the waveguide substrate to the inner layer conductor is approximately equal to one fourth of an in-substrate effective wavelength of the signal wave.

6. The waveguide connection structure according to claim 1, wherein a distance from the surface of the dielectric substrate opposing the waveguide substrate to the inner layer conductor is approximately equal to one fourth of an in-substrate effective wavelength of the signal wave.

7. The waveguide connection structure according to claim 1, wherein the surface conductor includes:

an inside surface conductive pattern that is formed in the surrounding of the through hole on the surface dielectric layer, which is the surface of the dielectric substrate opposing the waveguide substrate;

an outside surface conductive pattern that is formed in a surrounding of the inside surface conductive pattern while being positioned apart from the inside surface conductive pattern; and a conductor opening that is provided between the inside surface conductive pattern and the outside surface conductive pattern and in which the dielectric part is exposed.

8. The waveguide connection structure according to claim 7, wherein the through hole and the waveguide hole are both rectangular-shaped, the inside inner layer conductive pattern is circular shaped that is centered on a central axis of the through hole and that passes through a point positioned away from a middle point of an E-plane edge of the through hole by approximately $\lambda/4$, where $\lambda$ denotes a free-space wavelength of a signal wave, the dielectric part is ring shaped that is formed in a surrounding of the inside surface conductive pattern which is circular shaped, the inside surface conductive pattern is circular shaped that is centered on the central axis of the through hole and that passes through a point positioned away from the middle point of the E-plane edge of the through hole by approximately $\lambda/4$, and the conductor opening is ring shaped that is formed in a surrounding of the inside surface conductive pattern which is circular shaped.

9. The waveguide connection structure according to claim 8, wherein a distance from the surface of the dielectric substrate opposing the waveguide substrate to the inner layer conductor is approximately equal to one fourth of an in-substrate effective wavelength of the signal wave.

10. The waveguide connection structure according to claim 7, wherein a distance from the surface of the dielectric substrate opposing the waveguide substrate to the inner layer conductor is approximately equal to one fourth of an in-substrate effective wavelength of the signal wave.

* * * * *